US005897009A

United States Patent [19]

O'Meara

[11] Patent Number: 5,897,009

[45] Date of Patent: Apr. 27, 1999

[54] ONE-PIECE CONTAINER CLOSURE ASSEMBLIES

[75] Inventor: John R. O'Meara, North Palm Beach, Fla.

[73] Assignee: Wheaton USA, Inc., Millville, N.J.

[21] Appl. No.: 08/953,261

[22] Filed: Oct. 17, 1997

Related U.S. Application Data

[60] Provisional application No. 60/028,286, Oct. 18, 1996.

[51] Int. Cl.[6] ..... B65D 1/02

[52] U.S. Cl. ..... 215/48; 215/50; 215/253; 222/541.5; 222/541.6

[58] Field of Search ..... 215/48–50, 253; 206/63.5, 528; 222/541.6, 541.5

[56] References Cited

U.S. PATENT DOCUMENTS

| | | | |
|---|---|---|---|
| 2,742,202 | 4/1956 | Dresen et al. | 222/541.5 |
| 2,750,068 | 3/1956 | Platt, Jr. . | |
| 2,930,063 | 2/1960 | Stull . | |
| 3,187,966 | 6/1965 | Klygis . | |
| 3,204,835 | 9/1965 | Michel | 222/541.5 |
| 3,858,739 | 1/1975 | Turner et al. . | |
| 4,260,065 | 4/1981 | Van Cromvoirt . | |
| 4,512,475 | 4/1985 | Federighi . | |
| 4,867,326 | 9/1989 | O'Meara . | |
| 5,255,804 | 10/1993 | Butterbrodt . | |

FOREIGN PATENT DOCUMENTS

| | | |
|---|---|---|
| 1432 208 | 1/1963 | Germany . |

*Primary Examiner*—Stephen K. Cronin
*Assistant Examiner*—Robin A. Hylton
*Attorney, Agent, or Firm*—Eugene E. Renz, Jr.

[57] ABSTRACT

A container-closure assembly made of a soft plastic material comprising an elongated tubular member having a hollow nozzle, the bore of the nozzle at the tip end defining a discharge opening, a cap member connected at one end to the tip of the nozzle by a fracturable bridge connection and having a outwardly flared skirt projecting from said one end, a hollow finger disposed interiorly of the skirt, and the opening of said finger adjacent said nozzle being of a smaller diameter than the discharge opening in the nozzle to define a stepped configuration.

7 Claims, 3 Drawing Sheets

ONE-PIECE CONTAINER CLOSURE ASSEMBLIES

This application claims the benefit of U.S. Provisional Application No. 60/028,286 filed Oct. 18, 1996.

FIELD OF THE INVENTION

The present invention relates to improvements in container closure-assemblies and particularly to improvements in one piece plastic assemblies having a breakaway neck or nozzle with an integral cap.

BACKGROUND OF THE INVENTION

Container closure assemblies of the above-described type are not new per se. The Turner et al U.S. Pat. No. 3,858,739, issued Jan. 7, 1975 entitled BREAKAWAY NECK CONTAINER WITH INTEGRAL CAP, shows a container closure assembly of the type to which the present invention relates. This assembly includes a container and cap which are initially integral, the container having a dropper type end with a passageway which in the integrated condition of the cap and container, preferably extends into the cap. The cap has an elongated finger engaging portion and frusta-conical end portions which are resistant to compression or deformation. The cap is provided with an internal projection. The container is open at its end remote from the cap for filling with a product and then sealed. When it is desired to discharge the contents, the cap is broken away from the container to permit discharge of contents through the passageway. After a given application, the cap can be inverted so that the internal finger in the cap engages in the passageway to reseal the contents.

SUMMARY OF THE INVENTION

Even though the container closure described above is effective for the purposes indicated, the present invention provides certain improvements in assemblies of this type which make the manufacture of the unit more economical and which provide certain functional advantages.

The present invention is particularly suited for delivery of certain medicaments. In these applications, the product in the tube can be expelled into a vial containing a different product which if previously mixed may not remain stable. Once mixed, the end product may be extracted by a pumping action. For example, a normal unstable antibiotic can mix with an anti-inflammatory drug using the container closure assembly of the present invention and the mixed product can be placed in a vaporizer for lung infections. In these applications, the container functions as a pump to withdraw the mixed product from a glass vial. The tube nozzle and nozzle bore configuration are important design considerations for operating of the assembly as a pump.

BRIEF DESCRIPTION OF THE DRAWINGS

These and other objects of the present invention and various features and details of the operation and construction thereof, are hereinafter more fully set forth with reference to the accompanying drawings, wherein.

DESCRIPTION OF THE PREFERRED EMBODIMENT

Figure 1:
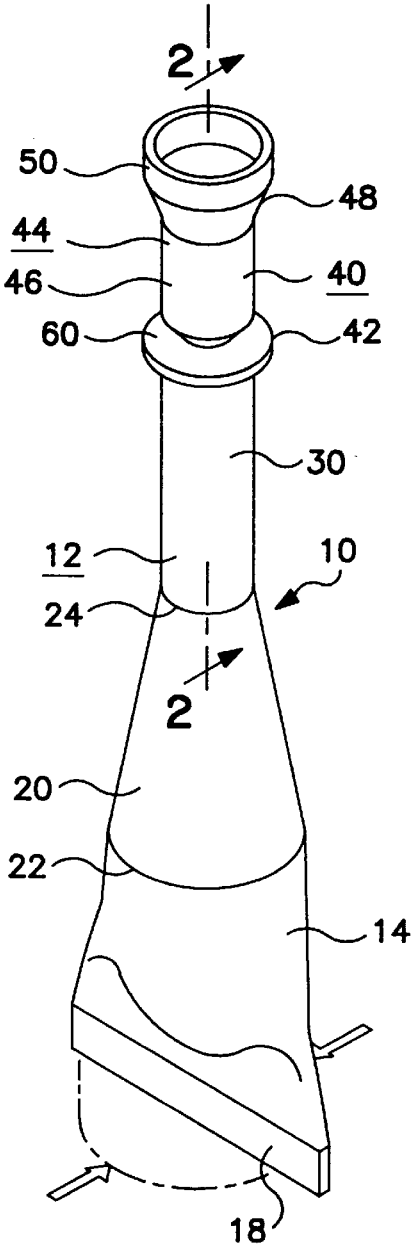
FIG. 1 is an isometric view of a container-closure assembly in accordance with the present invention.
Figure 2:
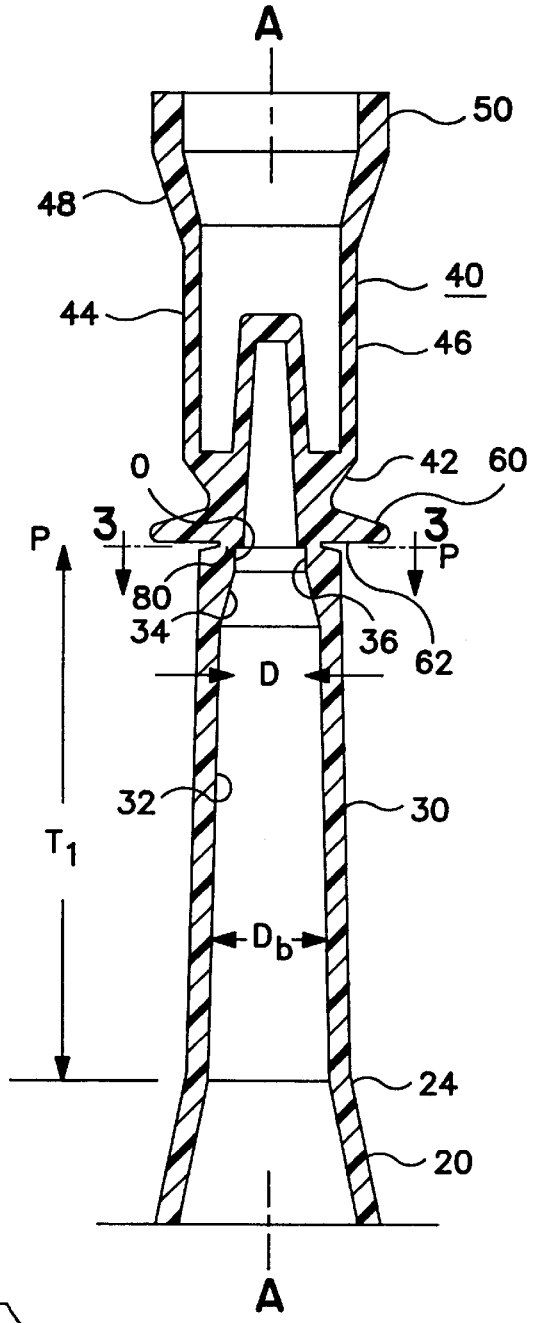
FIG. 2 is an enlarged fragmentary sectional elevational view taken on lines 2—2 of FIG. 1.
Figure 3:
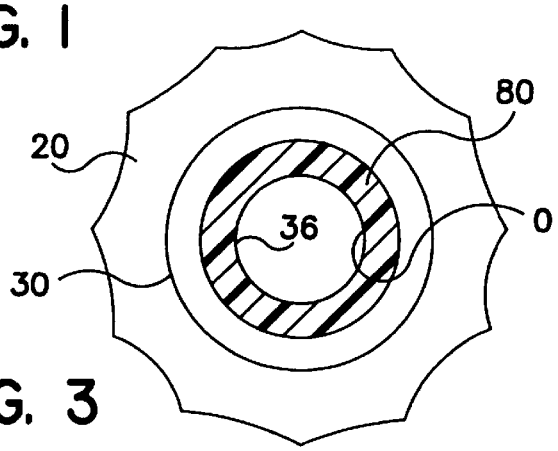
FIG. 3 is an enlarged fragmentary sectional plan view taken along lines 3—3 of FIG. 2.

Referring now to the drawings, and particularly to FIGS. 1 and 2 thereof, there is shown a container-closure assembly in accordance with the general invention, generally designated by the numeral 10, which is preferably, as illustrated, a one-piece assembly made of a plastic material. The container-closure assembly of the present invention is preferably made of a linear, low-density polyethylene to provide the desired flexibility needed for the pumping action when using the assembly as part of a delivery system to mix different drug products. The container or tube 12 has an enlarged body portion 14 which tapers downwardly and outwardly at a smaller angle than the intermediate section 20. The lower end of the tube 12 is normally open to permit filling of the container and which after filling, is heat sealed as at 18 to seal the contents.

The container 12 further includes a generally frusta-conical intermediate section 20 which converges upwardly from its juncture with the body portion as at 22 to a relatively narrow, generally circular top as at 24. The tapered sections 14 and 20 defines a bellows-type configuration and produces a good pumping action when the user presses the container adjacent the juncture 22 of the tapered section. As shown in FIG. 1, the tapered sections belly out at the junction 22 when the lower edges of the tubes are sealed.

Extending upwardly from the intermediate section 20 is an elongated hollow nozzle 30. The bore 32 of the nozzle 30 terminates adjacent its upper end in an inwardly tapered section 34 and a short cylindrical discharge section 36, having a predetermined diameter D. By this configuration, the wall thickness of the nozzle 30 is greater adjacent the discharge opening O at its outer terminal end than for the major portion of the length of the nozzle 30, stiffening the zone adjacent the fracturable wall 80. The nozzle is preferably of a length to engage interiorly of a vial and reach the bottom thereof to ensure complete evacuation of a mixed medicament when the container closure assembly of the present invention are used for this specific purpose. The length L of the nozzle 30 is preferably at least one (1) inch. Further, the bore diameter $D_b$ is preferably of an enlarged size on the order of up to 0.210 inches to ensure full flow during discharge of contents and complete evacuation of product when using it as a pump to mix medicaments. The bore diameter may vary depending on the products being mixed.

The closure or cap 40, as illustrated in FIG. 2, is formed integrally with the container. It is of generally cup-like shape comprising a top section 42 and a hollow skirt 44. The skirt 44, as illustrated, has a generally cylindrical section 46 projecting from the top 42 which is of an internal diameter $D_1$ to snugly embrace the nozzle 30 of the container in the manner shown in FIG. 5, a slightly flared out portion 48, and a generally cylindrical terminal end 50. The inner diameter $D_2$ of the terminal end 50, is greater than the outer diameter $D_4$ of the nozzle 30 and is spaced therefrom when the cap is seated on the container to provide an easy circumferentially extending gripping area for removing the cap when desired. This arrangement makes it easier to guide the cap over the nozzle 30 of the container without looking. In other words, it provides a bigger target.

Figure 5:
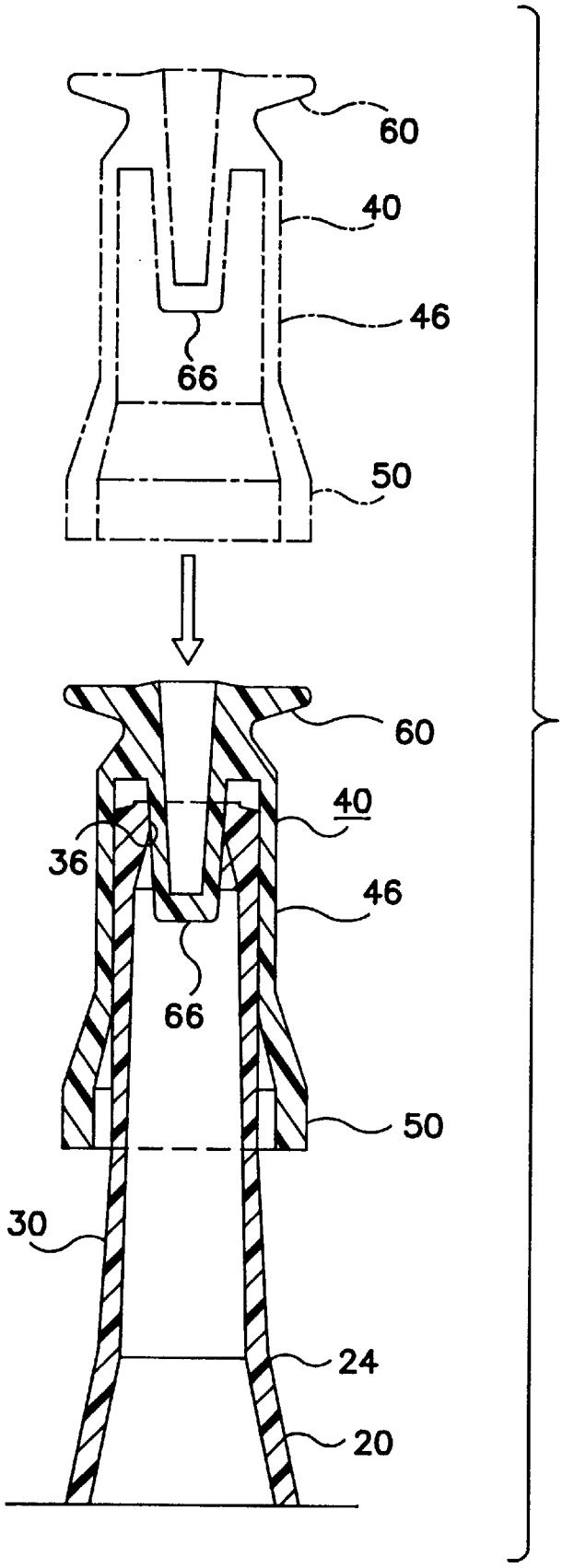
FIG. 5 is a view similar to FIG. 4 but showing the closure reapplied to the container.

The top 42 as illustrated has a circumferentially extending outwardly directed flange 60, having a flat downwardly depending face 62, generally perpendicular to the axis A—A of the container and the upper face of the flange 60 is slightly tapered. The flange 60 functions as a shield to prevent contamination of the nozzle by the gripping fingers of a user during opening. The top 42 also includes an upwardly projecting hollow finger 66 having an opening 68 adjacent the lower face of the flange 60 which is of a diameter $D_5$ less than the diameter $D_6$ of the discharge opening 36 to provide a stepped configuration. It has been found that stepped bore provides a cleaner break minimizing the formation of jagged edges and, thus, minimizing the risk of injury to the mouth of the user when discharging medicament orally. This configuration also prevents sealing over the material and blockage of the discharge opening when initially removing the cap from the container in the fractured zone area 80. The juncture of the discharge opening 36 and finger opening 68 defines a fracturable wall 80 for separation of the cap from the closure along the plane P—P. The flange 60 forms a stiffened pivot point zone and a finger guide stop so again you do not have to look. The hollow tapered post finger 66 combined with the soft linear polyethylene material facilitates slight deformation allowing a tight seal to be formed when inserted in the opening 36 of the container nozzle 30 as shown in FIG. 5. The finger 66 is preferably tapered towards its tip as at 66*a* to provide a good seal in the bore of the nozzle 30 when the cap is re-applied.

Figure 4:
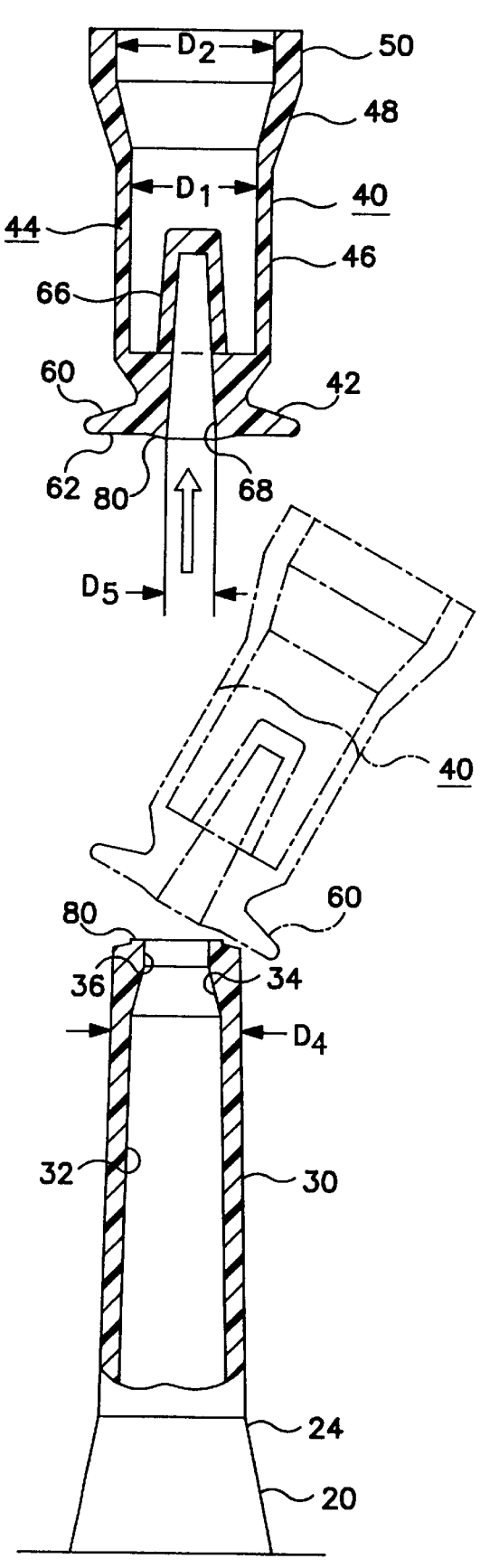
FIG. 4 is an enlarged fragmentary exploded sectional elevational view showing removal of the closure from the container.

The container-closure assembly are normally integral as explained above and the lower end of the container body 16 is normally open. The container lends itself to filling in automatic systems while in an upside down position. Thus the design facilitates handling in automated systems for filling and sealing containers of this type. After the container is filled, the contents are sealed until ready for use by means of a heating and crimping operation. When it is desired to discharge the contents, the user simply grips the cap 40 and pivots it to separate the cap from the container along the fracturable wall 80 connecting the container-closure in the manner shown in FIG. 4. If less than all of the contents are dispensed, the cap can be reassembled to seal the container with the plug 66 engaging in the discharge opening 36 and the cap embracing the elongated nozzle 30 of the container in the manner shown in FIG. 5.

Even though a particular embodiment of the present invention has been illustrated and described herein, it is not intended to limit the invention and changes and modifications may be made therein within the scope of the following claims.

What is claimed is:

1. A container-closure assembly made of a soft plastic material comprising:

an elongated tubular member having a hollow nozzle, the bore of the nozzle at the tip end defining a discharge opening;

a cap member connected at one end to the tip of the nozzle by a fracturable bridge connection;

a hollow tapered finger disposed interiorly of the cap member;

said cap member comprising a generally cylindrical section which snugly embraces the nozzle when the cap is inverted so that said finger engages in the discharge opening;

the diameter of the finger at a point between its extremities being greater than said discharge opening to provide a good seal when it is inserted in the discharge opening; and the opening of said finger adjacent said nozzle being of a smaller diameter than the discharge opening in the nozzle to define a stepped configuration and thereby define a fracture plane whereby the inner end of the finger opening is located at the fracture plane.

2. A container-closure assembly as claimed in claim 1 wherein the cap has a radially, outwardly directed, circumferentially extending flange adjacent the fracture plane connecting the cap to the nozzle of a diameter greater than the outer diameter of the nozzle.

3. A container-closure assembly as claimed in claim 1 wherein the bore of the nozzle has a stepped frusto-conical section which tapers upwardly and connects the discharge opening to the major bore of the nozzle.

4. A container-closure assembly as claimed in claim 1 wherein the skirt of the cap portion comprises of a generally cylindrical section which snugly embraces the nozzle when the cap is inverted to that the finger engages in the discharge opening and a flared-out terminal skirt portion which is spaced radially outwardly from the outer peripheral wall of the nozzle in the stopper position.

5. A container-closure assembly as claimed in claim 1 wherein the cap member includes a flared-out terminal skirt portion which is spaced radially outwardly from the outer peripheral wall of the nozzle to define a circumferential gripping edge facilitating removal of the cap portion when desired.

6. A container-closure assembly as claimed in claim 1 wherein the opening of the finger extends from one end to the other end.

7. A container-closure assembly as claimed in claim 1 wherein the cap has a radially outwardly directed flange adjacent the fracture plane with a diameter greater than the outer diameter of the nozzle portion of the container.

* * * * *